United States Patent [19]

Yerushalmi

[11] 4,437,382

[45] Mar. 20, 1984

[54] BOMB DISPOSAL DEVICE

[76] Inventor: Yaakov Yerushalmi, Rechov Hapartisanim 3, Petach Tikva, Israel

[21] Appl. No.: 300,897

[22] Filed: Sep. 9, 1981

[30] Foreign Application Priority Data

Sep. 14, 1980 [IL] Israel ..... 61035

[51] Int. Cl.[3] ..... F42D 5/04; F24B 33/06; E06B 9/00

[52] U.S. Cl. ..... 86/1 B

[58] Field of Search ..... 86/1 B; 150/52 H; 109/1 R, 23, 45

[56] References Cited

U.S. PATENT DOCUMENTS

| | | | |
|---|---|---|---|
| 3,800,715 | 4/1974 | Boller | 86/1 B X |
| 3,820,435 | 6/1974 | Rogers | 86/1 B X |
| 4,187,758 | 2/1980 | Petty | 86/1 B |

*Primary Examiner*—Donald G. Kelly

*Attorney, Agent, or Firm*—Benjamin J. Barish

[57] ABSTRACT

A bomb disposal device comprises an outer protective housing of spheroidal configuration formed with upper and lower openings and pivotably mounted between a pair of wheels for transporting the device to the location of a suspected bomb. An open-top container and a cover overlying the container are disposed within the protective housing and are fixed to the mounting thereof such that the container and cover remain in their upright vertical positions during the pivoting of the housing. The device further includes a netting which may be used for drawing the suspected bomb into the container within the housing. The protective housing is pivoted to a horizontal position when drawing, or manually placing, the suspected bomb into the container within the housing, and then the housing is pivoted to its upright position when the device is to be towed to a location for disposing the suspected bomb.

10 Claims, 5 Drawing Figures

FIG. 4
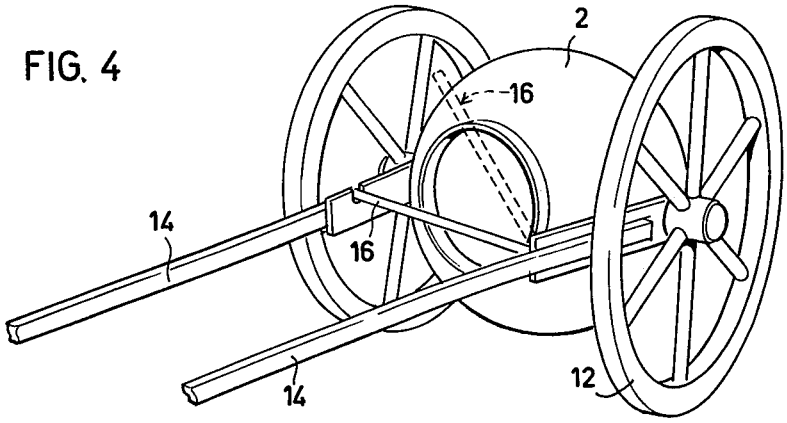
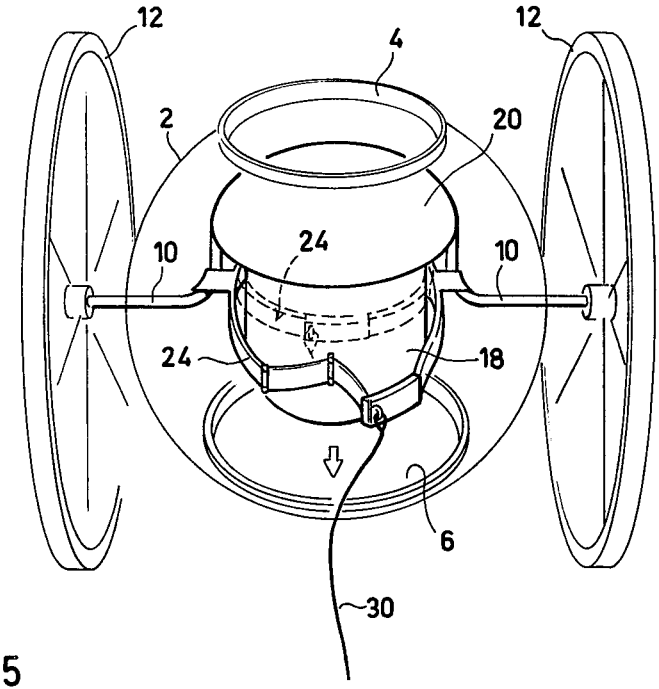
FIG. 5

BOMB DISPOSAL DEVICE

BACKGROUND OF THE INVENTION

The present invention relates to a bomb disposal device, and particularly to a device which may be used for handling and disposing of an article known or suspected of being a bomb or other explosive article.

In recent times there has been an increase in the number of incidents wherein terrorists, saboteurs, or other criminals place bombs and other explosive devices in public places having a large concentration of people or equipment for purposes of wreaking havoc, death, injury, and/or property damage. Obviously, extreme care must be exercised in handling such devices whenever even slightly suspected of being a bomb. To the present time, no entirely satisfactory equipment has been devised for handling suspected bombs. Such equipment should be simple, compact and producible at relatively low cost so as to make it widely available, and at the same time should provide maximum amount of protection to the handler from the time of detection of the suspected bomb until its final disposition.

BRIEF SUMMARY OF THE INVENTION

An object of the present invention is to provide a bomb disposal device having many advantages in the above respects.

According to a broad aspect of the present invention, there is provided a bomb disposal device comprising a high-strength outer housing formed with first and second openings on opposite sides, both leading into its interior; pivotal mounting means permitting the housing to pivot about a horizontal axis from an upright position wherein the first and second openings are in substantial vertical alignment, to a horizontal position wherein they are in substantial horizontal alignment; and an inner, open-ended container within the housing and fixed with respect to the mounting means, such that the container's open end is disposed upwardly and underlies the housing first opening in the upright position of the housing. The bomb disposal device further includes a cover within the housing and fixed with respect to the mounting means to overlie the open end of the container. The latter cover is of larger dimensions than the housing first (upper) opening, such that, in the event of explosion of a bomb within the container while the outer housing is in its upright position, the cover will be blown against the housing first (upper) opening to close it, and thereafter to direct the force of the explosion downwardly through the housing second (lower) opening.

In the preferred embodiment of the invention described below, the pivotal mounting means of the outer housing comprises horizontal axle means supported on wheels externally of the housing to permit rolling the device over the ground, said container and cover being fixed to said axle means within the housing.

The described preferred embodiment further includes a tow bar pivotably mounted to said axle means externally of the housing for towing the device over the ground.

According to another feature included in the described preferred embodiment, the device further includes a netting secured to one end of a cable supported with respect to the housing such that the netting may be passed through the housing lower opening to enclose a suspected bomb, and then the cable may be drawn to draw it, and the suspected bomb enclosed thereby, through the housing lower opening into the interior of the housing.

In accordance with another preferred feature included in the described embodiment, the inner container is supported within said housing on a releasable holder which may be actuated to release the container, together with any article received therein, to drop by gravity through the housing lower opening when the housing is in its upright position.

As will be described more particularly below, a bomb disposal device including the foregoing features may be constructed at relatively low cost and may be used to handle various types of suspected bombs in a manner providing a relatively high degree of protection to the handler.

Further features and advantages of the invention will be apparent from the description below.

BRIEF DESCRIPTION OF THE DRAWINGS

The invention is herein described, by way of example only, with reference to the accompanying drawings, wherein:

FIG. 4 is a perspective view illustrating the external construction of the bomb disposal device of FIGS. 1–3; and FIG. 5 is a view more particularly illustrating the releaseable holder arrangement for releasably holding the inner container within the housing in the device of FIGS. 1–3.

DESCRIPTION OF A PREFERRED EMBODIMENT

Figure 1:
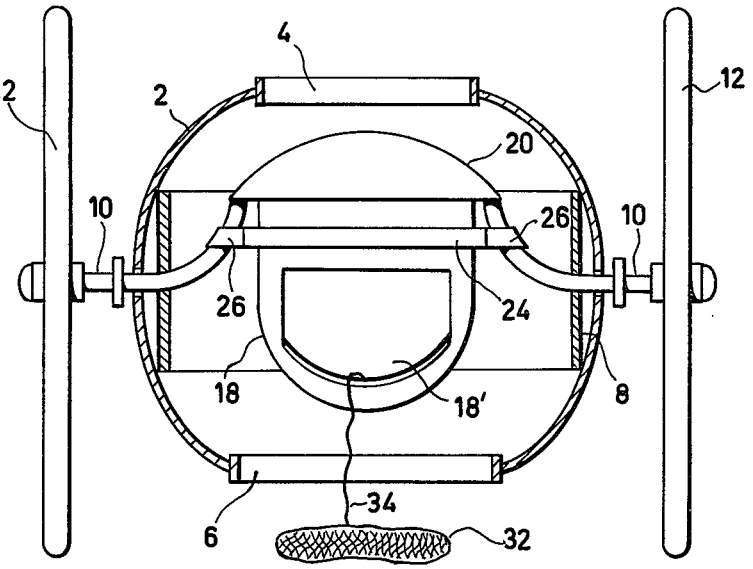
FIG. 1 is an end view diagrammatically illustrating one form of bomb disposal device constructed in accordance with the present invention.

The bomb disposal device illustrated in the drawings comprises a protective outer housing, generally designated 2, formed with an opening 4 at its upper end and another opening 6 at its lower end, both leading into the interior of the housing. The housing is of substantially spheroidal shape and is formed of high-strength material, such as steel or reinforced plastic. Its center portion is reinforced by an inner cylinder 8 secured within its interior, as by welding. Both of the housing openings 4 and 6 are of circular configuration, the lower opening 6 being of larger diameter than the upper opening.

Figure 2:
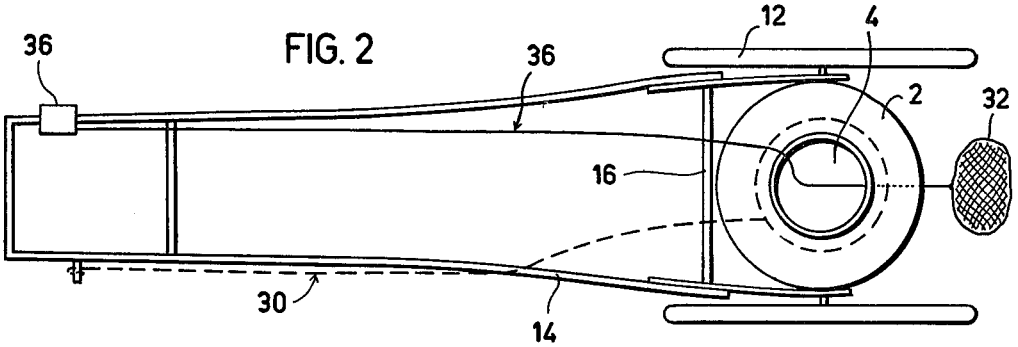
FIG. 2 is a top view diagrammatically illustrating the device of FIG. 1.

Outer housing 2 is carried by a pair of horizontal axles 10 mounted on a pair of wheels 12 rollable along the ground for transporting the device to any desired location. Housing 2 is pivotably mounted on the horizontal axles 10 permitting the housing to be pivoted from an upright position, as shown in FIGS. 1 and 2 wherein the two housing openings 4 and 6 are in vertical alignment, to a substantially horizontal position, indicated by the diagram in FIG. 3, wherein the two housing openings are in substantial horizontal alignment.

A pair of tow bars 14 are pivotably mounted to the axles 10 for towing the device to a desired location. The tow bars 14 straddle the outer housing 2 and include a releasable cross-bar 16, as shown particularly in FIG. 4, for retaining the housing in its horizontal position during the towing of the device to the desired location, as will be described more particularly below.

Figure 3:
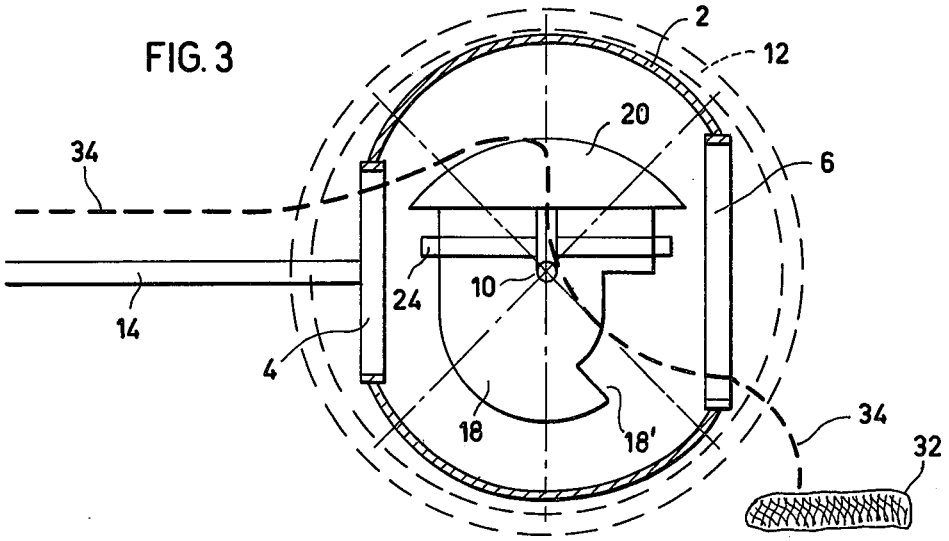
FIG. 3 is a side view diagrammatically illustrating the device of FIGS. 1 and 2, wherein the outer housing is pivoted to its horizontal position.

An inner open-top container 18, and a cover 20 for the container, are both disposed within housing 2. Cover 20 is secured between the inner ends of the horizontal axles 10, which inner ends are curved for this purpose as shown in FIG. 1. Thus, the cover remains in the horizontal position not only when housing 2 is in its normal upright position (FIG. 1), but also when it is pivoted to its horizontal position (FIG. 3). The inner container 18 also remains in the illustrated FIG. 1 position, underlying the cover 20, when the outer housing 2 is pivoted horizontally, and for this purpose the inner container 18 is supported by an annular holder ring 24 fixed, as by extensions 26, to the inner ends of the axles 10 to which the cover 20 is also secured.

The open top of container 18 is aligned with and underlies cover 20 and the upper housing opening 4. Container 18 is of circular cross-section and has a smaller diameter than the lower housing opening 6. A side wall of container 18 is cut-out, as shown by the opening 18' in FIGS. 1 and 3, to provide a side access opening for manually placing a suspected package or article into it. Container 18 may be of rigid material, e.g. metal or plastic, or may be of screen or net-like material.

Holder 24 is of annular shape and engages the upper end of container 18 to support it in suspension. Preferably, holder 24 is in the form of an expansible ring which may be actuated externally of the device, e.g. by pulling on a string 30 as shown in FIGS. 2 and 5, to cause the ring to expand, and thereby to permit the container 18 and its contents to drop by gravity through the lower housing opening 6 into a security hole or tank (not shown) for detonation of the article, if it turns out to be a bomb.

The illustrated device further includes a netting 32 secured to one end of a cable 34, which cable is payed over the cover 20 within housing 2 and extends through the upper housing opening 4 to a winding drum 36 carried by the tow bars 14. Netting 32 is intended to be passed out through the lower housing opening 6 and to enclose a suspected bomb, at which time the operator, by operating the winding drum 36, may draw the netting 32, together with the suspected bomb enclosed by it, through the lower housing opening 6 and into the inner container 18.

The illustrated device may be used in the following manner: Upon discovery of an article suspected of being a bomb, the device is wheeled to the location of the suspected article. The outer housing 2 is pivoted to its horizontal position and is releasably held in that position by the cross-bar 16 attached across towing bars 14. The operator, after making the required preliminary examination of the article without touching it, gently encloses it within the netting 32. He then stands behind the housing 2, i.e. facing (but out of alignment with) the upper housing opening 4, and operates the winding drum 36 so as to draw the netting 32, including the article enclosed thereby, gently through the lower housing opening 6 and into the inner container 18 within the housing. He then pivots the housing 2 to its upright position, as illustrated in FIG. 1. He may now tow the device to a security hole or tank which he aligns with the lower housing opening 6. He then releases holder 24, by pulling string 34, to permit the container 18 and its contents to drop through the lower housing opening 6 into the security hole or tank, as shown in FIG. 5.

The illustrated device provides a number of protective features when used in this manner for disposing a suspected bomb. Thus, during the drawing of the bomb into the housing 2 by the use of the netting 32, no door has to be opened or closed, and the operator may be located quite remote from the suspected bomb. Moreover, he is protected from it by the outer housing 2 which is located between him and the suspected bomb. Once the suspected bomb is within the housing, and the housing is pivoted to its normal upright position for towing to the security hole or tank, the operator is protected from a possible explosion by the high strength outer housing. In the event the object should explode during the towing operation, the force of the blast will be applied to the cover 20, which will cause the cover to be severed from the horizontal axles 10, forcing the cover against the housing upper opening 4. Since the cover 20 is of larger diameter than that opening, this will effectively terminate the further upward force of the blast, and will thereafter direct the force of the blast vertically downwardly through the lower housing opening 6 into the ground.

The removal of the suspected article from the housing 2 is also effected in a relatively safe manner, and without opening and closing any door, by pulling on string 30 to expand holder 24, and thereby to permit the inner container 18, together with the suspected bomb, to drop through the lower housing opening 6 into the security hole or tank (FIG. 5).

It will be appreciated that some of the described features of the invention could advantageously be used without others. For example, the netting 32 could be omitted, whereupon the suspected article would be placed by hand through the lower opening 6 into the inner container 18. In addition, in some locations there is no need to transport the suspected article to another location, in which case the wheels 12 could be omitted and the housing 2 pivotably mounted to a relatively fixed support.

It will also be appreciated that the described device may be used for other applications, e.g., as a general refuse container, flower container, or the like.

Many other variations, modifications and applications of the invention may be made.

I claim:

1. A bomb disposal device, comprising:

a high-strength outer housing formed with a first opening and a second opening on opposite sides thereof, both leading into its interior;

pivotal mounting means for said outer housing to permit pivoting same about a horizontal axis from an upright position wherein said first and second openings are in substantial vertical alignment, to a horizontal position wherein they are in substantial horizontal alignment;

an inner, open-ended container within said housing and fixed with respect to said mounting means such that the container's open end is disposed upwardly and underlies said housing first opening in the upright position of the housing;

and a cover within said housing and fixed with respect to said mounting means to overlie the open end of the container;

said cover being of larger dimensions than said housing first opening such that in the event of explosion of a bomb within said container while the outer housing is in its upright position, the cover will be blown against said housing first opening to close same and thereafter to direct the force of the explosion vertically downwardly through the housing second opening.

2. A device according to claim 1, wherein said pivotal mounting means of the outer housing comprises horizontal axle means supported on wheels externally of the housing to permit rolling the device over the ground, said container and cover being fixed to said axle means within the housing.

3. The device according to claim 2, further including a tow bar pivotably mounted to said axle means externally of the housing for towing the device over the ground.

4. The device according to claim 1, further including a netting secured to one end of a cable supported with respect to the housing such that the netting may be passed through the housing second opening to enclose a suspected bomb and then the cable may be drawn to draw it, and the suspected bomb enclosed thereby, through the housing, second opening into the interior of the housing.

5. The device according to claim 4, further including a winding drum externally of the housing and secured to the opposite end of the cable for drawing the cable and netting into the housing, the cable being payed over said cover within the housing so as to draw the netting and the suspected bomb into said inner container.

6. The device according to claim 1, wherein said inner container is supported within said housing on a releasable holder which may be actuated to release the container, together with any article received therein, to drop by gravity through the housing second opening when the housing is in its upright position.

7. The device according to claim 6, wherein the inner container is of annular shape at its top and is supported by said releasable holder engaging its top, which releasable holder is of annular shape and is expansible when actuated to release the container to drop therefrom by gravity.

8. The device according to claim 1, wherein said housing first and second openings are both of circular shape, the diameter of the second opening being larger than that of the first opening.

9. The device according to claim 1, wherein said outer housing is of substantially spheroidal shape.

10. The device according to claim 9, wherein the outer housing is reinforced by an inner reinforcing cylinder secured therein.

* * * * *